US008358261B2

(12) United States Patent
Jiang et al.

(10) Patent No.: US 8,358,261 B2
(45) Date of Patent: Jan. 22, 2013

(54) LIQUID CRYSTAL DISPLAY

(75) Inventors: Jian-Xun Jiang, Sanxia Town (TW); Chang Ming Chiu, Zhongli (TW)

(73) Assignee: Chimei Innolux Corporation, Miao-Li County (TW)

( * ) Notice: Subject to any disclaimer, the term of this patent is extended or adjusted under 35 U.S.C. 154(b) by 791 days.

(21) Appl. No.: 12/502,004

(22) Filed: Jul. 13, 2009

(65) Prior Publication Data

US 2010/0013822 A1 Jan. 21, 2010

(30) Foreign Application Priority Data

Jul. 16, 2008 (TW) ..... 97126929 A

(51) Int. Cl.
*G09G 3/36* (2006.01)

(52) U.S. Cl. ..... 345/99

(58) Field of Classification Search ..... None
See application file for complete search history.

(56) References Cited

U.S. PATENT DOCUMENTS

| | | | | |
|---|---|---|---|---|
| 7,292,216 | B2 * | 11/2007 | Yu et al. | 345/100 |
| 2006/0187178 | A1 * | 8/2006 | Sun | 345/100 |
| 2007/0296682 | A1 | 12/2007 | Hwang | |
| 2008/0136756 | A1 | 6/2008 | Yeo et al. | |

FOREIGN PATENT DOCUMENTS

| | | |
|---|---|---|
| CN | 1399408 | 2/2003 |
| CN | 101093649 | 12/2007 |
| CN | 101202024 | 6/2008 |
| TW | 200636754 | 12/1994 |

OTHER PUBLICATIONS

Office Action dated Mar. 26, 2012 from corresponding application No. CN 200810132219.1.
Office Action dated Oct. 22, 2012 from corresponding application No. TW097126929.
Office Action dated Sep. 7, 2012 from corresponding application No. CN200810132219.1.

* cited by examiner

*Primary Examiner* — Joseph Haley
(74) *Attorney, Agent, or Firm* — Lowe, Hauptman, Ham & Berner, LLP

(57) ABSTRACT

A liquid crystal display (LCD) device is provided. The LCD device includes a LCD panel, which further includes a plurality of scan lines, a gate driving circuit, a clock circuit. The clock circuit includes a clock generator and an adjusting circuit. The clock generator generates a clock signal having a first high voltage level and a first low voltage level. The adjusting circuit, coupled to the clock generator, receives the clock signal and generates an adjusted clock signal having the same period as the clock signal. The adjusted clock signal has a second high voltage level and a second low voltage level. The gate driving circuit, coupled to the clock circuit, receives the adjusted clock signal as a gate driving signal in order to drive the scan lines.

11 Claims, 7 Drawing Sheets

LIQUID CRYSTAL DISPLAY

CROSS REFERENCE TO RELATED APPLICATIONS

This application claims the right of priority based on Taiwan Patent Application No. 097126929 entitled "Liquid Crystal Display", filed on Jul. 16, 2008, which is incorporated herein by reference and assigned to the assignee herein.

FIELD OF INVENTION

The invention relates to a LCD device, particularly to a LCD device adopting Low-Temperature Poly-Si Thin Film Transistors (LTPS TFT).

BACKGROUND OF THE INVENTION

LCD devices have several advantages and thus are generally adopted in the portable information products such as mobile phones, laptops, PDA, etc. However, conventional large-size LCD devices unavoidably suffer from the "flicker" problem, which becomes more serious with the size of LCD panel.

Generally, a LCD device has a LCD panel, wherein a gate driving circuit provides gate driving signals to turn on the TFTs on the scan line. Typically the gate driving signal is square-wave signal. However, parasitic capacitors/resistors on the scan line, resulting from the manufacture process, will result in RC delay and distort the waveform of the gate driving signal, as shown in FIG. 1A. The distortion becomes more serious when the gate driving signal goes to the rear parts of the scan line. Therefore the large-size LCD panel will need some solutions to this kind of flicker problem.

One conventional solution is to change the high and low reference voltage levels of the gate driving circuit so as to shift the highest level and the lowest level (VGH and VGL) of the gate driving signal and thus shape the gate driving signal. For example, as shown in FIG. 1B, U.S. Pat. No. 5,602,560 disclosed a LCD panel 1 with 1280×1024 pixels, which includes a data driving circuit 10, a gate driving circuit 12, and a compensation circuit 14. For a scan line S selected by the gate driving circuit 12, when the gate driving signal GS becomes OFF (low voltage level), the compensation circuit 14 will supply a compensation voltage CV, so as to shape the gate driving signal GS.

Conventional solutions to the flicker would require a variable voltage source. Although they can shape the gate driving signal, the variable voltage source will consume more power. Moreover, conventional solutions will make the circuit implementation complicated and increase the manufacture cost.

Therefore it is desired to have a novel LCD device adopting a simple, easy, and power saving way to shape the gate driving signal.

SUMMARY OF THE INVENTION

One aspect of the invention is to provide a LCD device, in which the clock signal, to be received by the gate driving circuit, is adjusted to have the desired waveform. Another aspect is to adopt a CMOS inverter to adjust the waveform of the clock signal. Therefore, the present invention has some advantages such as simple implementation and lower power consumption, without increasing the manufacture cost and time.

In one embodiment, a LCD device includes a LCD panel, which further includes a plurality of scan lines, a gate driving circuit, a clock circuit. The clock circuit includes a clock generator and an adjusting circuit. The clock generator generates a clock signal having a first high voltage level and a first low voltage level. The adjusting circuit, coupled to the clock generator, receives the clock signal and generates an adjusted clock signal having the same period as the clock signal. The adjusted clock signal has a second high voltage level and a second low voltage level. The clock signal has a first transition period from the first low voltage level to the first high voltage level, and the adjusted clock signal has a second transition period from the second low voltage level to the second high voltage level. The first transition period is shorter than the second transition period. The gate driving circuit, coupled to the clock circuit, receives the adjusted clock signal as a gate driving signal in order to drive the scan lines. The second high voltage level and the second low voltage level are the highest voltage level and the lowest voltage level of the gate driving signal.

In another embodiment, the adjusting circuit includes a level shifter, and each scan line includes a number of LTPS TFTs. In yet another embodiment, the LTPS TFTs and the gate driving circuit are formed on the same glass substrate.

The foregoing and other features of the invention will be apparent from the following more particular description of embodiments of the invention.

BRIEF DESCRIPTION OF THE DRAWINGS

The present invention is illustrated by way of example and not intended to be limited by the figures of the accompanying drawings, in which like notations indicate similar elements.

DETAILED DESCRIPTION

Figure 1A:
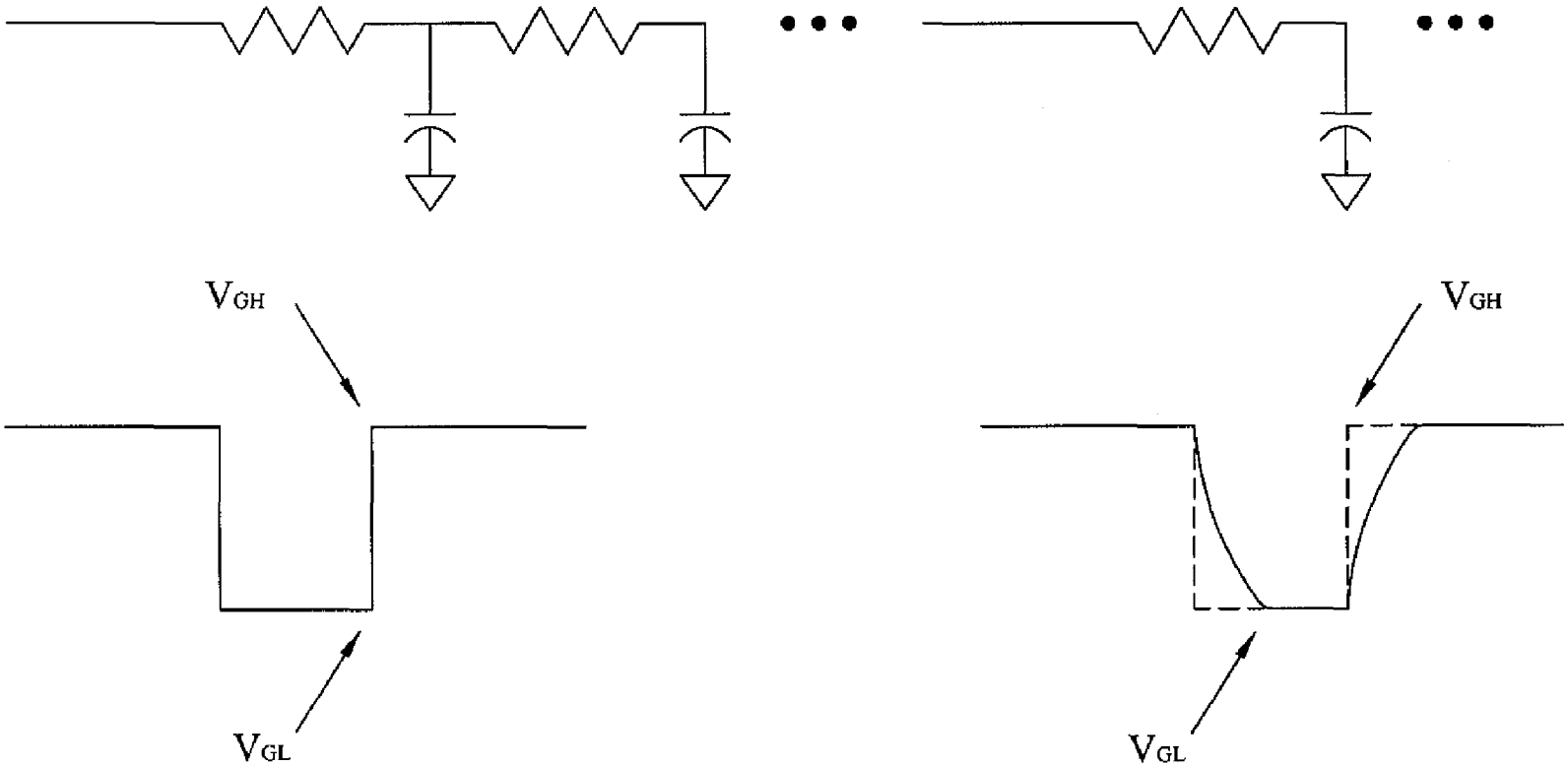
FIG.1A (Prior Art)
FIG. 1A shows the distortion of a square-wave driving signal.
Figure 1B:
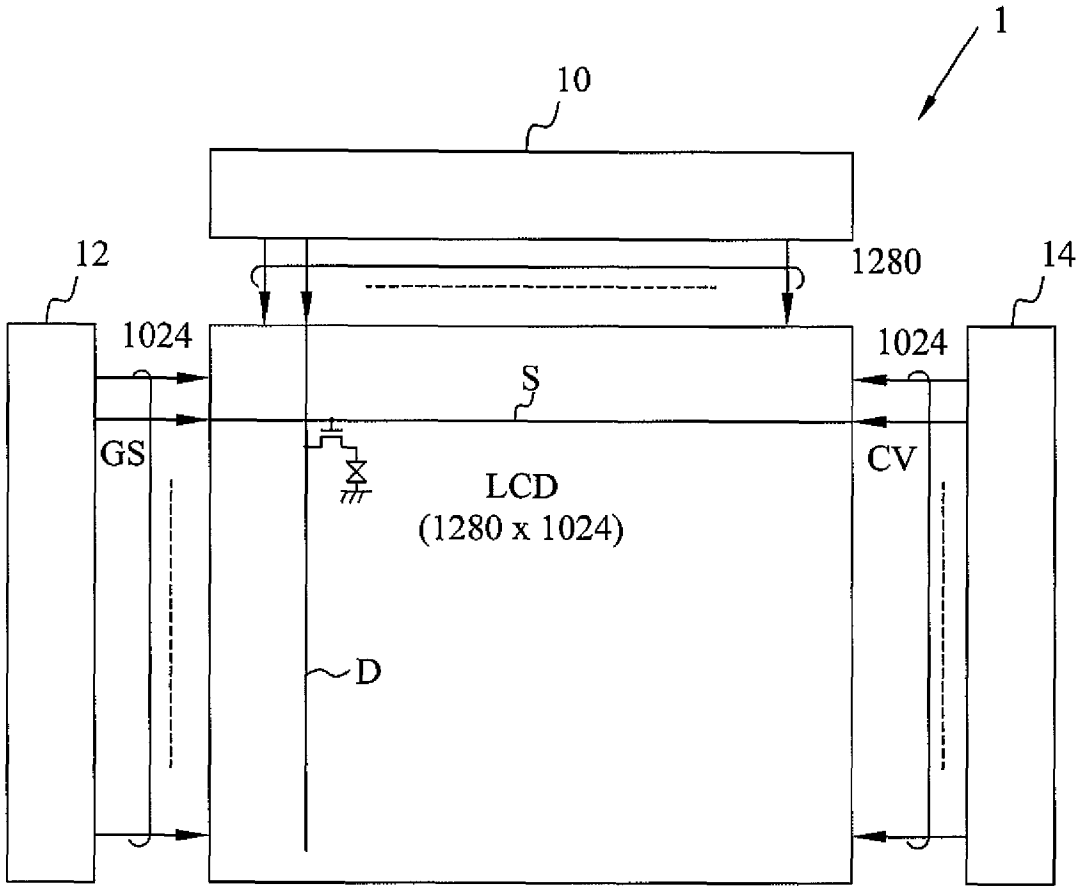
FIG.1B (Prior Art)
FIG. 1B illustrates a LCD device according to prior arts.
Figure 2A:
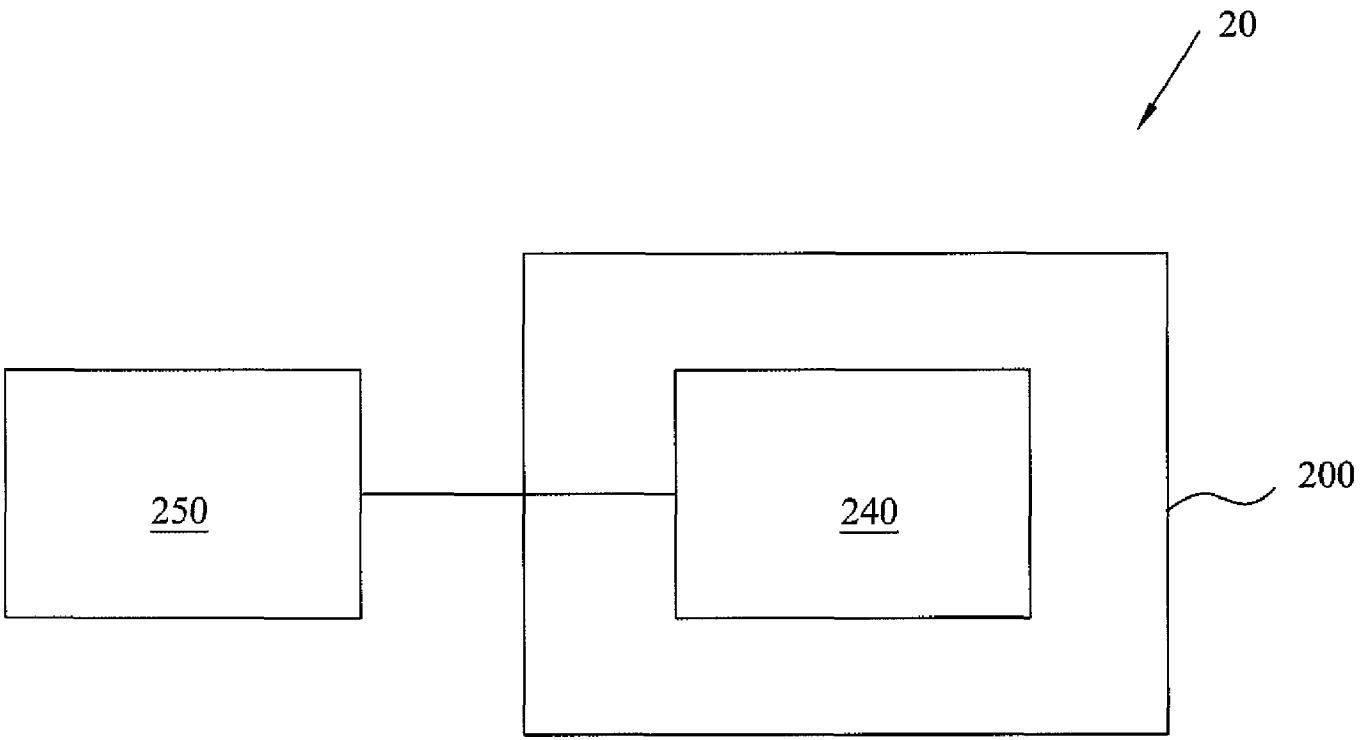
FIG. 2A illustrates a LCD device according an embodiment of the present invention.

FIG. 2A schematically show a LCD device 20 according to an embodiment of the invention. The LCD device 20 could be embedded in a mobile phone, a digital still-picture camera, a car navigation system, a mobile DVD-player, a gaming device, or a hand-held consumer appliance, a television, a computer monitor, a large-screen consumer electronics device, or a professional appliance. In the embodiment, the LCD device 20 includes a power supply 250 and a LCD panel 200 having the clock circuit 240. The power supply 250 is connected to the LCD panel 200 to supply power to the LCD panel 200. Note that the dimensional and the scale and the relative positions of elements in the drawings are used to explain the invention, but should not be construed in a limiting sense.

Figure 2B:
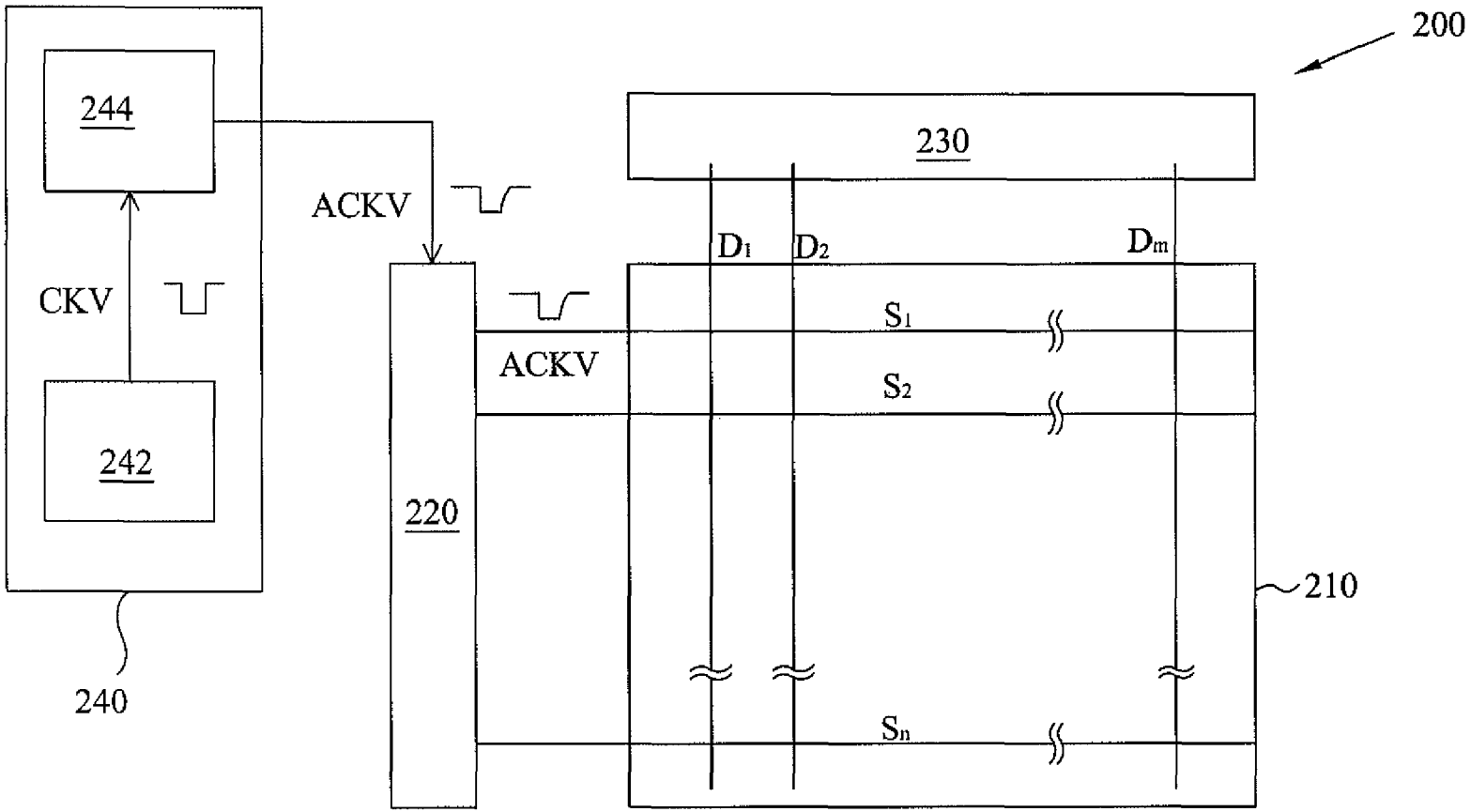
FIG. 2B illustrates a LCD panel according an embodiment of the present invention.

The LCD device 20 includes LCD panel 200. As further shown in FIG. 2B, the panel 200 includes a TFT array 210, a gate driving circuit 220, a data driving circuit 230, and a clock circuit 240. The gate driving circuit 220 and the data driving circuit 230 are provided to control the pixels on the panel 200 to present images through scan lines (S1-Sn) and data lines (D1-Dm), respectively. Particularly, TFTs 210 on the scan lines (S1-Sn) are switched ON/OFF by the gate driving circuit 220. This part should be known to those skilled in the art and thus is omitted hereinafter. Note that in the embodiment, the TFT array 210 could be implemented as LTPS TFTs. Furthermore, the gate driving circuit 220, the data driving circuit 230, and LTPS TFT 210 could be formed together on a same glass substrate (not shown). This arrangement can save the area for the peripheral circuit board and the manufacture cost.

The clock circuit 240 could be implemented as an Application-specific integrated circuit (ASIC), disposed on a circuit board beside the glass substrate (both not shown). The clock circuit 240 further includes a clock generator 242 and an adjusting circuit 244. The clock generator 242 generates a clock signal CKV, which is a square-wave signal and has a first high voltage level and a first low voltage level, as 3.3V and 0V, for example. The details about how the clock generator 242 generates the clock signal CKV could be referred to the clock circuit in the conventional LCD panels and thus omitted hereinafter.

Different from the conventional clock circuit, in the clock circuit 240, the adjusting circuit 244 is connected to the clock generator 242 to receive the clock signal CKV, in order to generate an adjusted clock signal ACKV. The adjusted clock signal ACKV has the same period as the clock signal CKV and also has a second high voltage level and a second voltage low voltage level. In this embodiment, the second high voltage level, 12V, and the second low voltage level, −6V, are respectively set as the highest voltage level VGH and the lowest voltage level VGL of the gate driving signal.

Figure 2C:
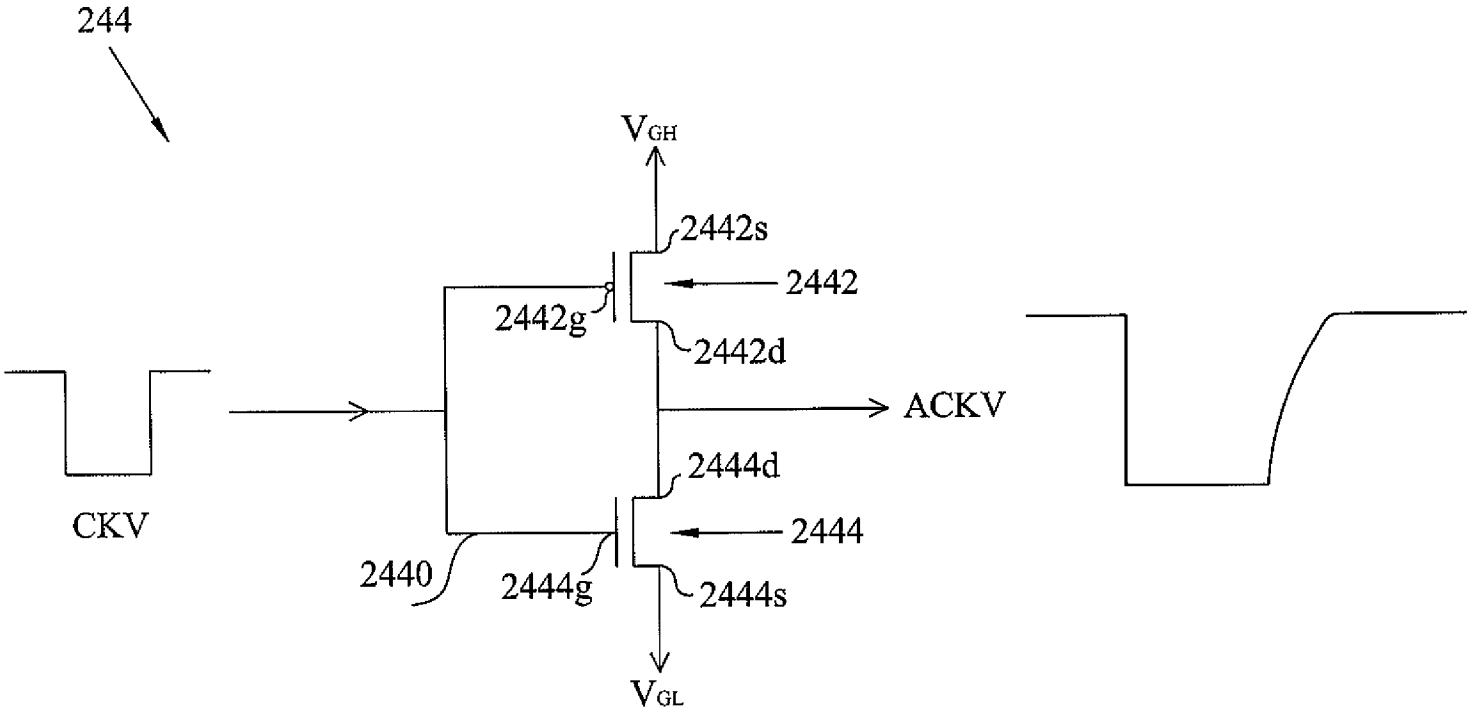
FIG. 2C illustrates a clock circuit according an embodiment of the present invention.
Figure 2D:
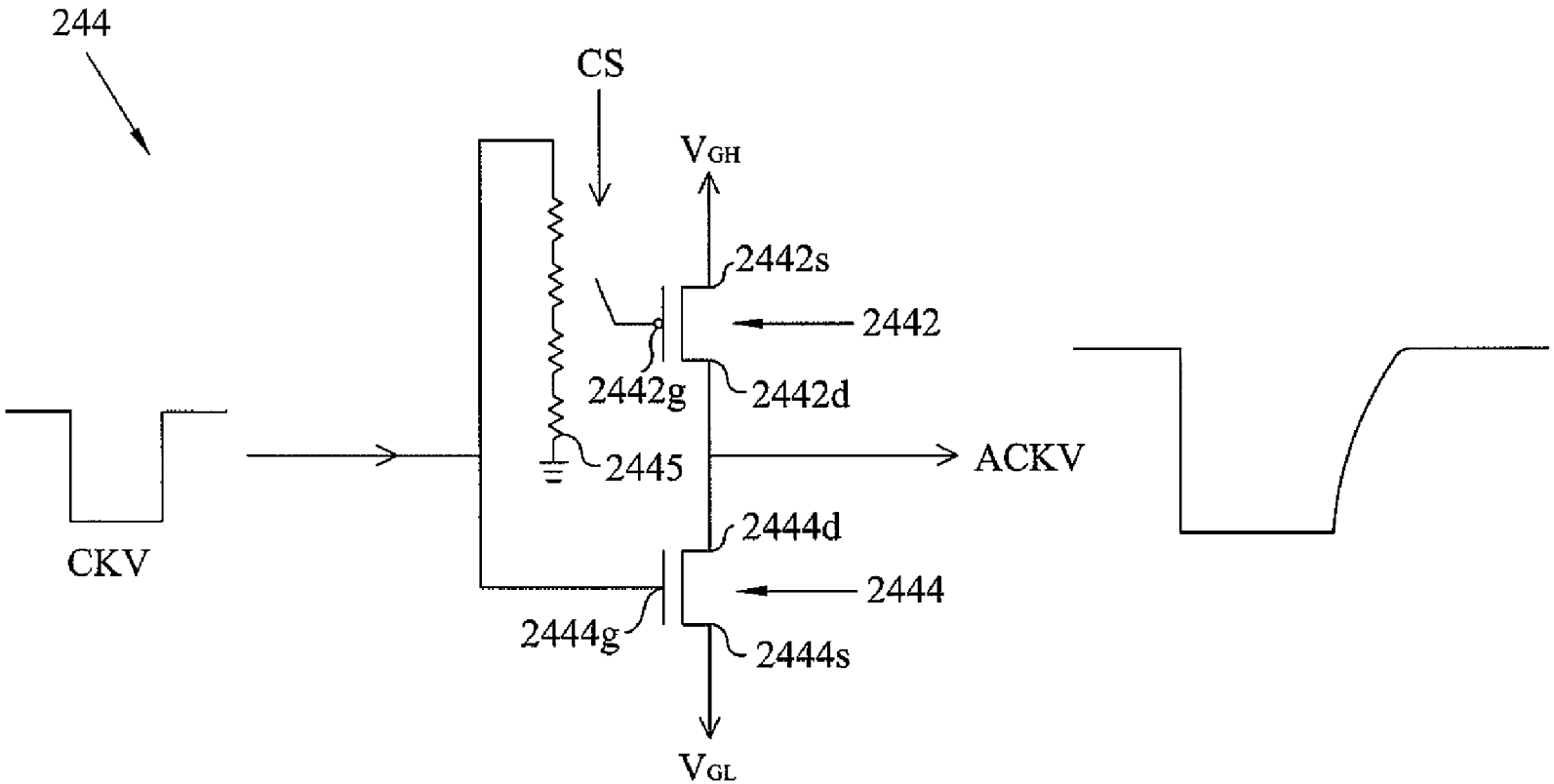
FIG. 2D illustrates a clock circuit according another embodiment of the present invention.

Note that the rising edge of the clock signal CKV is shorter than the rising edge of the adjusted clock signal ACKV (as shown in FIGS. 2C and 2D later). In other words, the clock signal CKV has a first transition period from the first low voltage level (0V) to the first high voltage level (3.3V), and the adjusted clock signal ACKV has a second transition period from the second low voltage level (−6V) to the second high voltage level (12V). Accordingly, the first transition period is shorter than the second transition period. More detailed about this part will be provided later together with FIGS. 2C and 2D. Then the gate driving circuit 220 is coupled to the clock circuit 240 to receive the adjusted clock signal ACKV. The gate driving circuit 220 further inputs the adjusted clock signal ACKV, in turn, into each scan line (S1-Sn) as a gate driving signal to drive the TFTs 210 on the scan lines. In this embodiment, TFTs 210 could be configured as being switched ON when the adjusted clock signal ACKV is higher than 8V and being switched OFF when the adjusted clock signal ACKV is lower than 0V.

As shown in FIG. 2C, the adjusting circuit 244 includes a level shifter, such as CMOS inverter 2440, in which the source 2442*s* of PMOS 2442 receives a high level signal carrying a second high voltage level VGH (12V) and the source 2444*s* of NMOS 2444 receives a low level signal carrying a second low voltage level VGH (−6V). Then the clock signal CKV is received by gates 2444*g* and 2442*g* of NMOS and PMOS to form gate-source voltages (Vgs) on the NMOS and the PMOS, and the adjusted clock signal ACKV is outputted from drains 2444*d* and 2442*d* of the NMOS and the PMOS.

Figure 3:
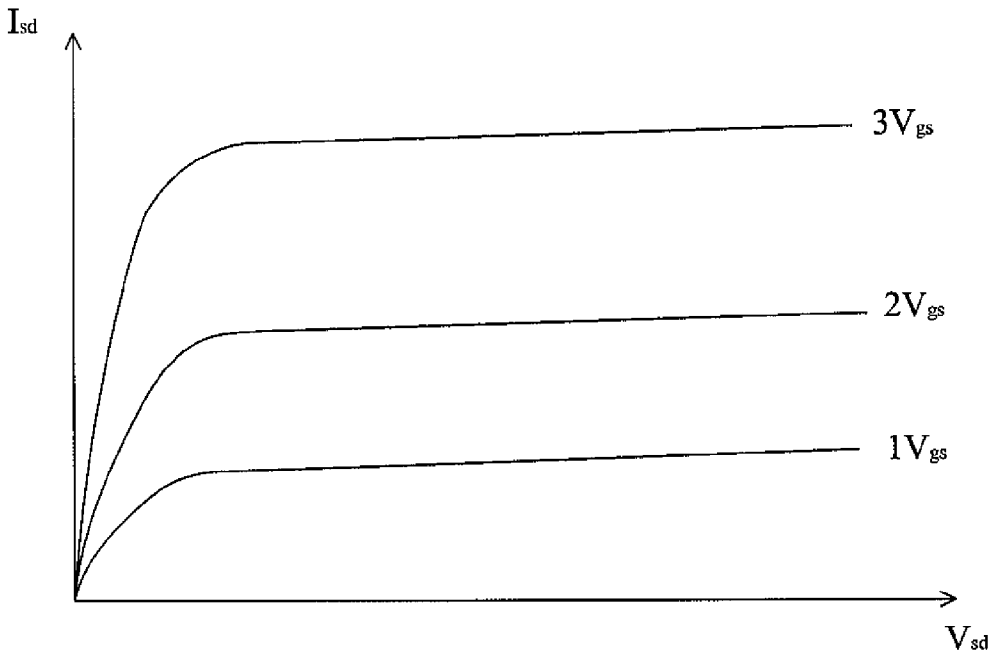
FIG. 3 shows the relationship between the drain-source voltage and the drain-source current under different gate-source voltages, according an embodiment of the present invention.

In PMOS, the drain current will increase along with the gate-source voltage (Vgs). Therefore the transition period of the clock signal CKV from the first low voltage level to the first high voltage level is shorter than the transition period of the adjusted clock signal ACKV from the second low voltage level (i.e., VGL) to the second high voltage level (i.e., VGH). In other word, the adjusted clock signal ACKV is shaped by PMOS in this embodiment, so that the rising edge of the adjusted clock signal ACKV resembles a sinusoidal wave and goes up slower. Note that when the clock signal CKV changes from the first low voltage level (0V) to the first high voltage level (3.3V), the first high voltage level of the clock signal CKV will determine the gate-source voltage (Vgs) on PMOS, as shown in FIG. 3. A lower gate-source voltage (Vgs) on PMOS will result in a lower drain-source current (Isd) and makes longer the transition period of the adjusted clock signal ACKV from the second low voltage level to the second high voltage level. As a result, the adjusted clock signal ACKV has a longer rising edge with slower rising speed than the clock signal CKV.

In the embodiment shown in FIG. 2D, in contrast to FIG. 2C, the adjusting circuit further includes a voltage divider 2445. The voltage divider 2445 can include a variable resistor and is connected to the gate 2442*g* of PMOS 2442. The voltage divider 2445 divides the voltage level of the clock signal CLK in response to a control signal CS to dynamically adjust the gate-source voltage (Vgs) and further adjust the length and the rising speed of the rising edge of the adjusted clock signal ACLK. As mentioned above, a lower gate-source voltage (Vgs) on PMOS results in a lower drain-source current (Isd) and makes longer the transition period of the adjusted clock signal ACKV from the second low voltage level to the second high voltage level. As a result, the adjusted clock signal ACKV has a longer rising edge with slower rising speed than the clock signal CKV. One advantage of the design shown in FIG. 2D lies in that the rising speed of the rising edge of the adjusted clock signal ACKV can be adjusted dynamically, in response to the numbers of TFT or the capacitance or the resistance of the scan lines, so as to obtain an optimized result.

While this invention has been described with reference to the illustrative embodiments, these descriptions should not be construed in a limiting sense. Various modifications of the illustrative embodiment, as well as other embodiments of the invention, will be apparent upon reference to these descriptions. It is therefore contemplated that the appended claims will cover any such modifications or embodiments as falling within the true scope of the invention and its legal equivalents.

The invention claimed is:

1. A liquid crystal display (LCD) device, comprising a LCD panel, said LCD panel comprising:

a plurality of scan lines;

a gate driving circuit; and a clock circuit, said clock circuit comprising:

a clock generator for generating a clock signal having a first high voltage level and a first low voltage level; and an adjusting circuit, coupled to said clock generator, for receiving said clock signal and generating an adjusted clock signal, said adjusted clock signal having the same period as said clock signal and having a second high voltage level and a second low voltage level;

wherein said clock signal has a first transition period from said first low voltage level to said first high voltage level, said adjusted clock signal has a second transition period from said second low voltage level to said second high voltage level, and said first transition period is shorter than said second transition period;

wherein said gate driving circuit, coupled to said clock circuit, receives said adjusted clock signal as a gate driving signal in order to drive said scan lines;

wherein said adjusting circuit comprises:

a divider; and a CMOS inverter, said CMOS inverter comprising:

a PMOS, a source of said PMOS receiving a high level signal carrying said second high voltage level; and a NMOS, a source of said NMOS receiving a low level signal carrying said second low voltage level;

wherein said divider is connected to the gate of said PMOS, said clock signal is divided by said divider and is received by said divider and said gate of said NMOS to form gate-source voltages (Vgs) on said NMOS and said PMOS, and said adjusted clock signal is outputted from drains of said NMOS and said PMOS.

2. A LCD device according to claim 1, wherein said clock signal is a square-wave signal.

3. A LCD device according to claim 1, wherein said adjusting circuit comprising a level shifter.

4. A LCD device according to claim 1, wherein said second high voltage level and said second low voltage level are respectively the highest voltage level and the lowest voltage level of said gate driving signal.

5. A LCD device according to claim 1, wherein said divider is a variable divider, said divider divides said clock signal in response to a control signal to adjust said gate-source voltage.

6. A LCD device according to claim 1, wherein said divider comprises a variable resistor.

7. A LCD device according to claim 1, where each of said scan lines comprises a plurality of LTPS TFTs.

8. A LCD device according to claim 7, wherein said plurality of LTPS TFTs and said gate driving circuit are formed on a same glass substrate.

9. A LCD device according to claim 1, further comprising a power supply connected to said LCD panel for supplying power to said LCD panel.

10. A LCD device according to claim 1, wherein said LCD device is embedded in a mobile phone, a digital still-picture camera, a car navigation system, a mobile DVD-player, a gaming device, or a hand-held consumer appliance, a television, a computer monitor, a large-screen consumer electronics device, or a professional appliance.

11. An apparatus comprising a liquid crystal display (LCD) panel, said apparatus comprising a mobile phone, a digital still-picture camera, a car navigation system, a mobile DVD-player, a gaming device, or a hand-held consumer appliance, a television, a computer monitor, a large-screen consumer electronics device, or a professional appliance, and said LCD panel comprising:

a plurality of scan lines;

a gate driving circuit; and a clock circuit, said clock circuit comprising:

a clock generator for generating a clock signal having a first high voltage level and a first low voltage level; and an adjusting circuit, coupled to said clock generator, for receiving said clock signal and generating an adjusted clock signal, said adjusted clock signal having the same period as said clock signal and having a second high voltage level and a second low voltage level, wherein said clock signal has a first transition period from said first low voltage level to said first high voltage level, said adjusted clock signal has a second transition period from said second low voltage level to said second high voltage level, and said first transition period is shorter than said second transition period, wherein said gate driving circuit, coupled to said clock circuit, receives said adjusted clock signal as a gate driving signal in order to drive said scan lines, wherein said adjusting circuit comprises:

a divider; and a CMOS inverter, said CMOS inverter comprising:

a PMOS, a source of said PMOS receiving a high level signal carrying said second high voltage level; and a NMOS, a source of said NMOS receiving a low level signal carrying said second low voltage level, and wherein said divider is connected to the gate of said PMOS, said clock signal is divided by said divider and is received by said divider and said gate of said NMOS to form gate-source voltages (Vgs) on said NMOS and said PMOS, and said adjusted clock signal is outputted from drains of said NMOS and said PMOS.

* * * * *